US007506640B2

(12) United States Patent
Mizutani

(10) Patent No.: US 7,506,640 B2
(45) Date of Patent: Mar. 24, 2009

(54) IGNITION SYSTEM FOR INTERNAL-COMBUSTION ENGINE

(75) Inventor: Atsuya Mizutani, Obu (JP)

(73) Assignee: Denso Corporation, Kariya, Aichi-Pref. (JP)

( * ) Notice: Subject to any disclaimer, the term of this patent is extended or adjusted under 35 U.S.C. 154(b) by 0 days.

(21) Appl. No.: 11/949,867

(22) Filed: Dec. 4, 2007

(65) Prior Publication Data

US 2008/0141986 A1 Jun. 19, 2008

(30) Foreign Application Priority Data

Dec. 13, 2006 (JP) ..... 2006-335269

(51) Int. Cl.
*F02P 3/08* (2006.01)

(52) U.S. Cl. ..... 123/596; 123/605; 123/634

(58) Field of Classification Search ..... 123/596, 123/604–607, 634
See application file for complete search history.

(56) References Cited

U.S. PATENT DOCUMENTS 4,868,730 A * 9/1989 Ward ..... 363/21.12
4,964,377 A * 10/1990 Scarnera ..... 123/605
5,056,496 A 10/1991 Morino et al.
6,047,691 A * 4/2000 Ketterer ..... 123/634
6,142,130 A * 11/2000 Ward ..... 123/606
6,305,365 B1 * 10/2001 Maeoka et al. ..... 123/604
7,127,288 B2 * 10/2006 Sturman et al. ..... 607/2

FOREIGN PATENT DOCUMENTS

JP 2002-246247 8/2002

* cited by examiner

*Primary Examiner*—Erick Solis
(74) *Attorney, Agent, or Firm*—Nixon & Vanderhye PC

(57) ABSTRACT

An ignition system for an internal-combustion engine includes an ignition coil and an ignition control circuit. The ignition coil includes a primary coil and a secondary coil. The ignition control circuit includes a capacitor. The ignition control circuit employs a capacitor discharged ignition method, whereby the ignition control circuit is configured such that electrical charge, with which the capacitor is charged, is discharged into the primary coil to drive the ignition coil. A coupling coefficient, which indicates a degree of magnetic coupling between the primary coil and the secondary coil, is set in a range of 0.9 to 0.97. k, which is the coupling coefficient, is provided using a formula $k=(1-L1'/L1)^{1/2}$, wherein L1 is an inductance of the primary coil and L1' is an inductance of the primary coil when the secondary coil is short-circuited.

7 Claims, 5 Drawing Sheets

IGNITION SYSTEM FOR INTERNAL-COMBUSTION ENGINE

CROSS REFERENCE TO RELATED APPLICATION

This application is based on and incorporates herein by reference Japanese Patent Application No. 2006-335269 filed on Dec. 13, 2006.

BACKGROUND OF THE INVENTION

1. Field of the Invention

The present invention relates to an ignition system for an internal-combustion engine.

2. Description of Related Art

In an ignition system used in a vehicle, voltage is applied to a primary coil of an ignition coil using an igniter, into which an ignition control circuit having a switching element and the like is incorporated. In the ignition coil, when voltage is applied to the primary coil and then the voltage is stopped in response to a pulsed spark generating signal from an ECU (electronic control unit), an induction field is formed, thereby generating high-voltage induced electromotive force (counter electromotive force) in a secondary coil. Accordingly, a spark is generated between a pair of electrodes in a spark plug, which is attached to the ignition coil.

In order to increase an amount of electricity passed through the primary coil, electrical charge, with which a capacitor is charged, is discharged into the primary coil using the ignition control circuit, in which a CDI (capacitor discharged ignition) method is employed. For example, an ignition system of multispark type, which realizes ignition performance that is the same or more than a combination of a multiple ignition method (by which an energy accumulation coil is employed, and the energy accumulation coil and the primary coil are alternately switched on and off, to discharge electrical charge) and the capacitor discharged ignition method, is disclosed in JP2811781B2 (corresponding to U.S. Pat. No. 5,056,496). In the ignition system of multispark type, a discharge time, during which electrical charge is discharged into the primary coil, is stabilized, by switching on and off the energy accumulation coil and the primary coil alternately.

However, when the primary coil is energized using the ignition control circuit, in which the CDI method is employed, a distinctive high-frequency voltage component attributed to the capacitor overlaps with output voltage of the secondary coil. In an output voltage waveform of the secondary coil shown in FIG. 7, when generation timing of a peak Vt of the high-frequency voltage component overlaps with generation timing of a peak $V2_{max}$ of a spark voltage V2 in the secondary coil, the peak $V2_{max}$ necessary to the secondary coil may not be ensured.

SUMMARY OF THE INVENTION

The present invention addresses the above disadvantages. Thus, it is an objective of the present invention to provide an ignition system for an internal-combustion engine. The ignition system ensures a peak of a spark voltage in a secondary coil.

To achieve the objective of the present invention, there is provided an ignition system for an internal-combustion engine. The ignition system includes an ignition coil and an ignition control circuit. The ignition coil includes a primary coil and a secondary coil. The ignition control circuit includes a capacitor. The ignition control circuit employs a capacitor discharged ignition method, whereby the ignition control circuit is configured such that electrical charge, with which the capacitor is charged, is discharged into the primary coil to drive the ignition coil. A coupling coefficient, which indicates a degree of magnetic coupling between the primary coil and the secondary coil, is set in a range of 0.9 to 0.97, so that timing, with which a peak of a spark voltage in the secondary coil is generated, is shifted from timing, with which a peak of a high-frequency voltage component attributed to the capacitor is generated, in a voltage waveform outputted from the secondary coil. k, which is the coupling coefficient, is provided using a formula $k=(1-L1'/L1)^{1/2}$, wherein L1 is an inductance of the primary coil and L1' is an inductance of the primary coil when the secondary coil is short-circuited.

BRIEF DESCRIPTION OF THE DRAWINGS

The invention, together with additional objectives, features and advantages thereof will be best understood from the following description, the appended claims and the accompanying drawings in which:

DETAILED DESCRIPTION OF THE INVENTION

An embodiment of the present invention is described below.

In a voltage waveform outputted from a secondary coil, a peak of a high-frequency voltage component attributed to a capacitor may be generated after a peak of a spark voltage is generated.

Accordingly, the peak of the high-frequency voltage component is easily prevented from overlapping with the peak of the spark voltage.

By making length of the secondary coil in an axial direction shorter than length of a primary coil in the axial direction, a coupling coefficient k, which indicates a degree of magnetic coupling between a primary coil and the secondary coil, is set in a range of 0.9 to 0.97.

In this case, by appropriately setting the length of the secondary coil in the axial direction, an ignition coil with the coupling coefficient k in the range of 0.9 to 0.97 is easily formed.

In the axial direction of the primary coil and the secondary coil, an end portion of the primary coil may be projected further on a high-voltage side than a high-voltage side end portion of the secondary coil. Accordingly, the ignition coil with the coupling coefficient k in the range of 0.9 to 0.97 is easily formed. Also, a high-voltage current leaking from the high-voltage side end portion of the secondary coil is restricted, thereby ensuring high voltage reliability.

Alternatively, by making the length of the primary coil in the axial direction shorter than the length of the secondary coil in the axial direction, the coupling coefficient k is also set in the range of 0.9 to 0.97.

In this case, by appropriately setting the length of the primary coil in the axial direction, the ignition coil with the coupling coefficient k in the range of 0.9 to 0.97 is easily formed.

In the axial direction of the primary coil and the secondary coil, the high-voltage side end portion of the secondary coil may be projected further on the high-voltage side than the end portion of the primary coil.

Accordingly, the ignition coil with the coupling coefficient k in the range of 0.9 to 0.97 is also easily formed.

An ignition control circuit, in which a multiple ignition method is employed, may include an energy accumulation coil, a charge switching element, and a discharge switching element. The charge switching element switches on and off energization of the energy accumulation coil to charge the capacitor with electric energy, which is stored in the energy accumulation coil. The discharge switching element is for discharging electrical charge, with which the capacitor is charged, into the primary coil.

Accordingly, in the ignition control circuit, in which a CDI (capacitor discharged ignition) method and the multiple ignition method are employed, the high-frequency voltage component is prevented from overlapping with the peak of the spark voltage.

The embodiment of an ignition system for an internal-combustion engine according to the present invention is described with reference to the accompanying drawings.

Figure 1:
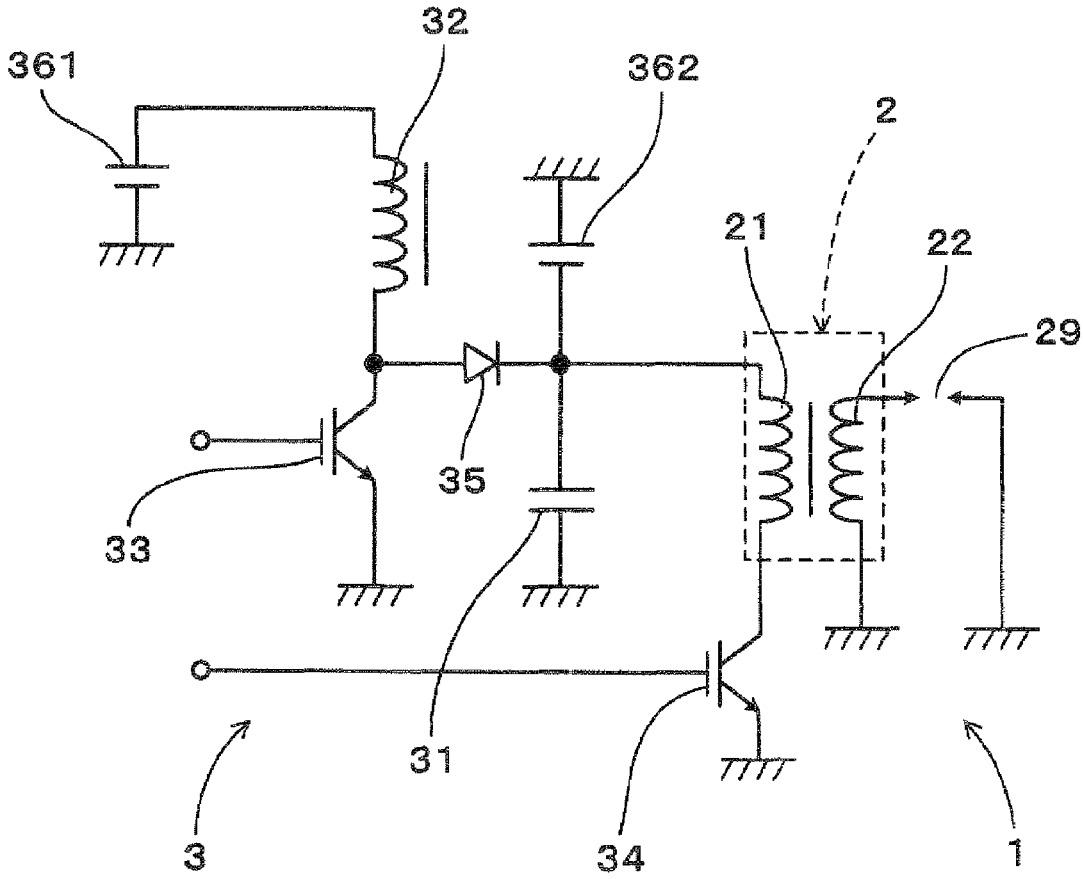
FIG. 1 is a schematic circuit diagram illustrating an ignition system for an internal-combustion engine according to an embodiment of the present invention.

In the embodiment, as shown in FIG. 1, an ignition system 1 for an internal-combustion engine includes an ignition coil 2 and an ignition control circuit 3. The ignition coil 2 includes a primary coil 21 and a secondary coil 22. The ignition control circuit 3 using the CDI method is configured such that electrical charge, with which a capacitor 31 is charged, is discharged into the primary coil 21, to drive the ignition coil 2. A multiple ignition method is employed in the ignition control circuit 3 of the embodiment.

In the ignition system 1 of the embodiment, a coupling coefficient k, which indicates a degree of magnetic coupling between the primary coil 21 and the secondary coil 22 and is expressed by the following mathematical formula (1), is set in a range of 0.9 to 0.97. Accordingly, in a voltage waveform outputted from the secondary coil 22, generation timing of a peak Vt of a high-frequency voltage component attributed to the capacitor 31 does not overlap with generation timing of a peak $V2_{max}$ of a spark voltage V2 of the secondary coil 22.

$$k=(1-L1'/L1)^{1/2} \quad (1)$$

L1 indicates an inductance of the primary coil 21, and L1' indicates an inductance of the primary coil 21 when the secondary coil 22 is short-circuited.

The ignition system 1 is described in detail below with reference to FIGS. 1 to 7.

In the ignition system 1 of the embodiment, the peak Vt of the high-frequency voltage component is prevented from overlapping with the peak $V2_{max}$ of the spark voltage V2, in the ignition control circuit 3, in which the CDI method and the multiple ignition method are employed.

Figure 2:
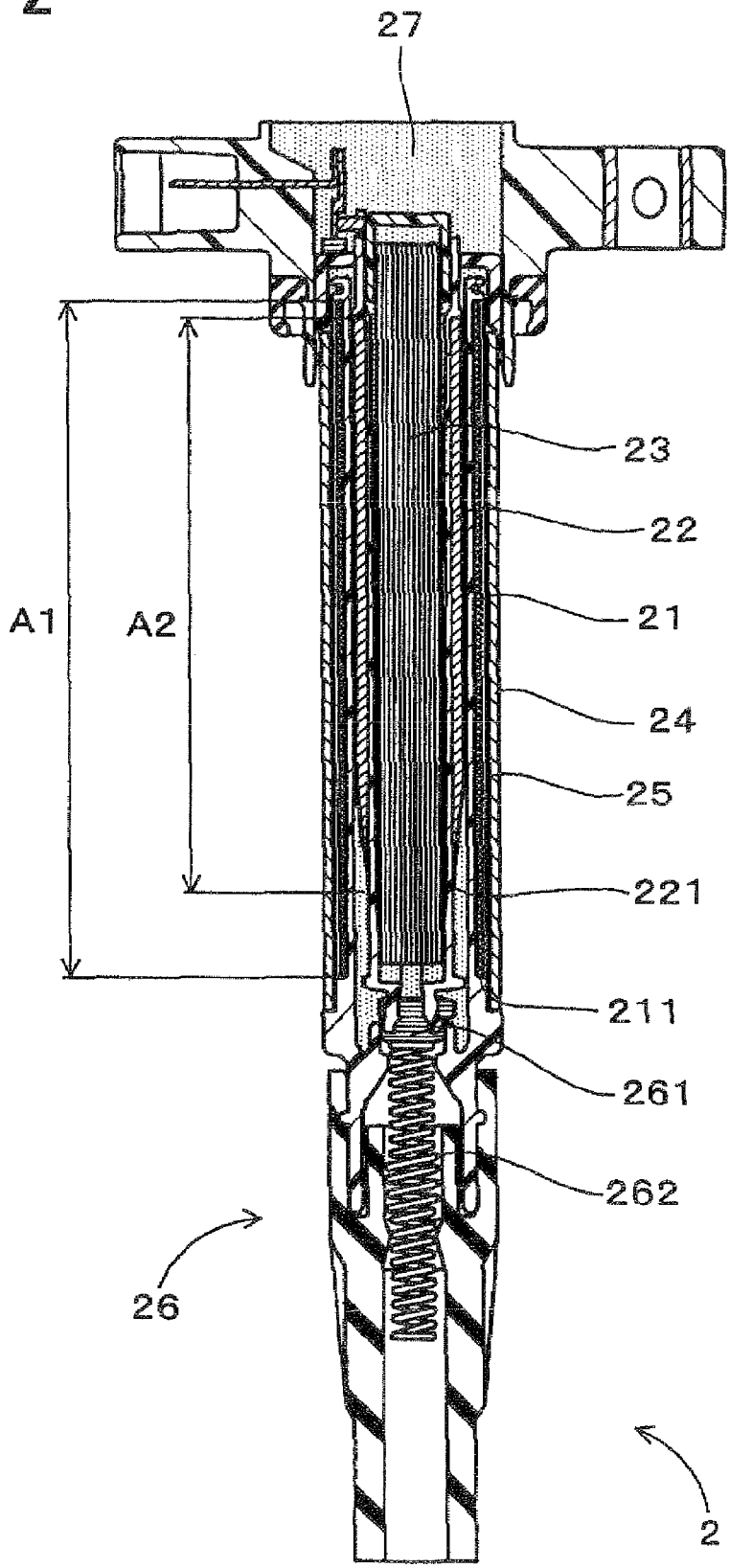
FIG. 2 is a sectional view illustrating an ignition coil in the ignition system according to the embodiment.

As shown in FIG. 2, the ignition coil 2 includes the primary coil 21, the secondary coil 22, and a coil case 25. The primary coil 21 and the secondary coil 22 are received in the coil case 25. The primary coil 21 and the secondary coil 22 are disposed concentrically with each other in positions in which they overlap. A center core 23, which is made of a soft magnetic material, is disposed on an inner circumferential side of the primary coil 21 and the secondary coil 22. An outer circumference core 24, which is made of a soft magnetic material, is disposed on an outer circumferential side of the primary coil 21 and the secondary coil 22. A plug attaching portion 26, to which a spark plug 29 (FIG. 1) is attached, is provided at an end portion of the ignition coil 2 in its axial direction. A high-voltage terminal 261 and a spring 262 are provided in the plug attaching portion 26. The high-voltage terminal 261 and a high-voltage side end portion 221 of the secondary coil 22 are brought into conduction. The high-voltage side end portion 221 and the spark plug 29 are brought into conduction. A gap in the coil case 25 is filled with epoxy resin 27, so that the primary coil 21, the secondary coil 22, the center core 23, and the like are insulated and fixed.

In the ignition system 1 of the embodiment, a spark is generated in the following manner. When an electric current is passed through the primary coil 21 in response to a spark generating signal from an ECU (electronic control unit) to the ignition control circuit 3, a magnetic field passing through the center core 23 and the outer circumference core 24 is formed. Then, when an electric current, which is passed through the primary coil 21, is stopped, an induction field passing through the center core 23 and the outer circumference core 24 is formed in an opposite direction from a direction in which the magnetic field is formed. As a result, high-voltage induced electromotive force (counter electromotive force) is generated in the secondary coil 22, thereby generating a spark between a pair of electrodes in the spark plug 29, which is attached to the ignition coil 2.

As shown in FIG. 1, the ignition control circuit 3 of the embodiment includes the capacitor 31, an energy accumulation coil 32, a charge switching element 33, and a discharge switching element 34. The capacitor 31 stores electrical charge, which is passed through the primary coil 21. The energy accumulation coil 32 is connected to the primary coil 21. The charge switching element 33 switches on and off energization of the energy accumulation coil 32. The discharge switching element 34 is for discharging electrical charge, with which the capacitor 31 is charged, into the primary coil 21. A diode 35 is provided between the energy accumulation coil 32 and the primary coil 21 to prevent a backflow of the electric current. Numerals 361, 362 indicate direct-current power sources.

In order to generate a spark using the ignition control circuit 3, the charge switching element 33 is switched on with the discharge switching element 34 switched off to store electric energy in the energy accumulation coil 32, at preliminary steps for ignition timing, with which the predetermined spark voltage V2 is generated. Then, by switching off the charge switching element 33, the capacitor 31 is charged with electric energy, which is stored in the energy accumulation coil 32.

At the ignition timing, when the discharge switching element 34 is switched on and off, the spark voltage V2 is generated in the secondary coil 22, thereby generating a spark between the pair of electrodes in the spark plug 29.

At the ignition timing, by switching on and off the charge switching element 33 and the discharge switching element 34 alternately for a predetermined discharge time after the discharge switching element 34 is switched on, the spark voltage V2 is steadily continued.

In the embodiment, as shown in FIG. 2, by making length (winding width) A2 of the secondary coil 22 in its axial direction shorter than length (winding width) Al of the primary coil 21 in its axial direction, and by projecting an end portion 211 of the primary coil 21 further on a high-voltage side than the high-voltage side end portion 221 of the secondary coil 22 in the axial direction of the primary coil 21 and the secondary coil 22, the coupling coefficient k is set in the range of 0.9 to 0.97. The coupling coefficient k is adjusted by appropriately modifying the ignition control circuit 3, the primary coil 21, the secondary coil 22, the center core 23, the outer circumference core 24, and the like.

Figure 6:
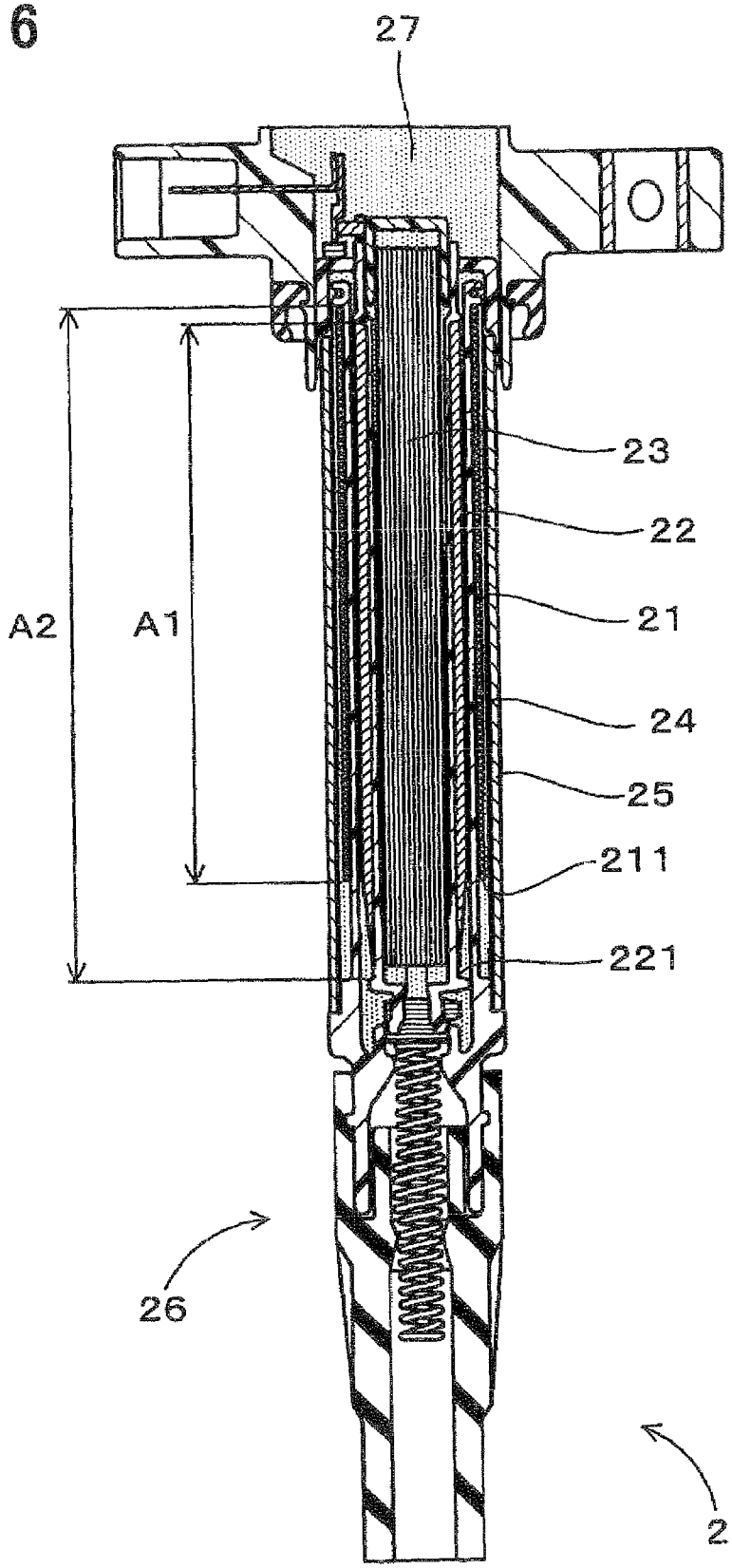
FIG. 6 is a sectional view illustrating another ignition coil in the ignition system according to the embodiment.

As shown in FIG. 6, by making the length (winding width) Al of the primary coil 21 in its axial direction shorter than the length (winding width) A2 of the secondary coil 22 in its axial direction, and by projecting the high-voltage side end portion 221 of the secondary coil 22 further on the high-voltage side than the end portion 211 of the primary coil 21 in the axial direction of the primary coil 21 and the secondary coil 22, the coupling coefficient k is also set in the range of 0.9 to 0.97.

The secondary coil 22 near its high-voltage side end portion 221 is formed in a shape in which its outer diameter decreases in a direction toward the end portion. By projecting the end portion 211 of the primary coil 21 further on the high-voltage side than the high-voltage side end portion 221, a high-voltage current leaking from the high-voltage side end portion 221 is restricted, thereby ensuring high voltage reliability.

Figure 3:
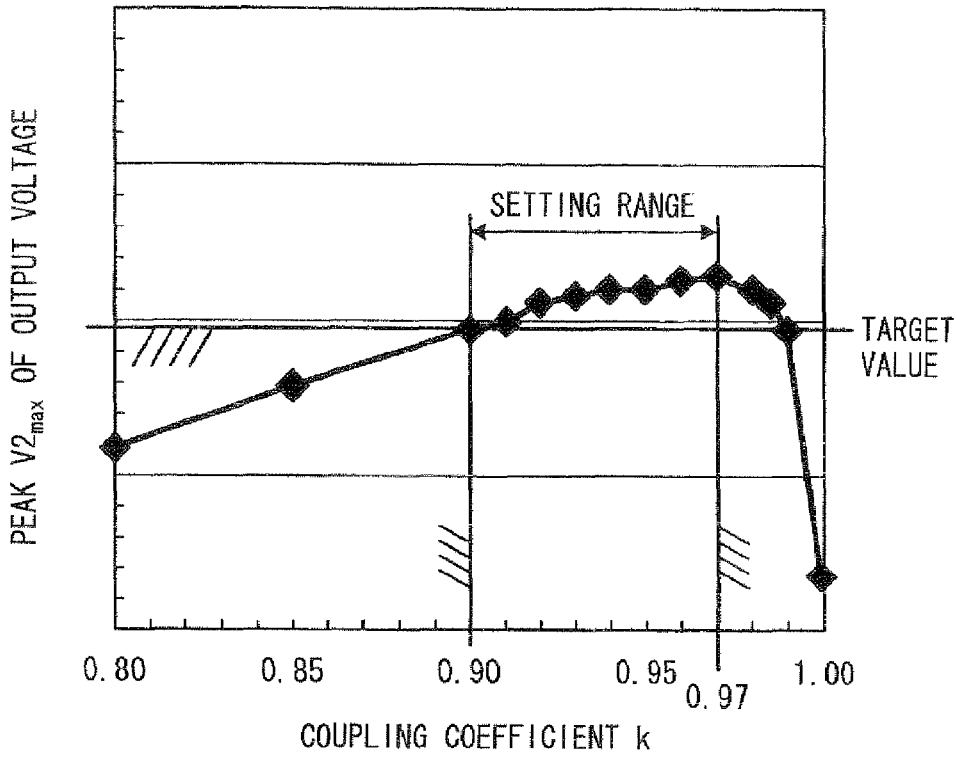
FIG. 3 is a graph illustrating a relationship between a coupling coefficient on its horizontal axis and a peak of an output voltage on its vertical axis according to the embodiment.

FIG. 3 is a graph showing a relationship between the coupling coefficient k on its horizontal axis and the peak $V2_{max}$ of the output voltage (spark voltage) V2 in the secondary coil 22 on its vertical axis. In a range in which the coupling coefficient k is equal to or smaller than 0.97 in the graph, as the coupling coefficient k increases, the peak $V2_{max}$ of the output voltage V2 increases. In a range in which the coupling coefficient k is larger than 0.97, as the coupling coefficient k increases, the peak $V2_{max}$ decreases. By setting the coupling coefficient k in the range of 0.9 to 0.97, the targeted peak $V2_{max}$ is outputted.

Figure 4:
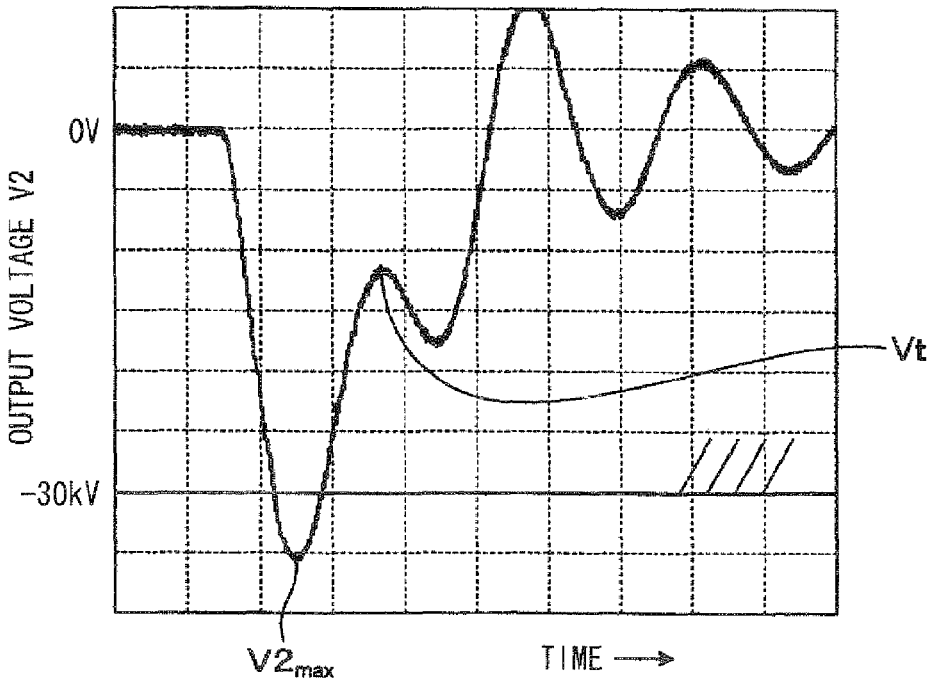
FIG. 4 is a graph illustrating an output voltage waveform with time on its horizontal axis and the output voltage on its vertical axis, when a peak Vt of a high-frequency voltage component is generated after generation of a peak $V2_{max}$ of the output voltage according to the embodiment.
Figure 5:
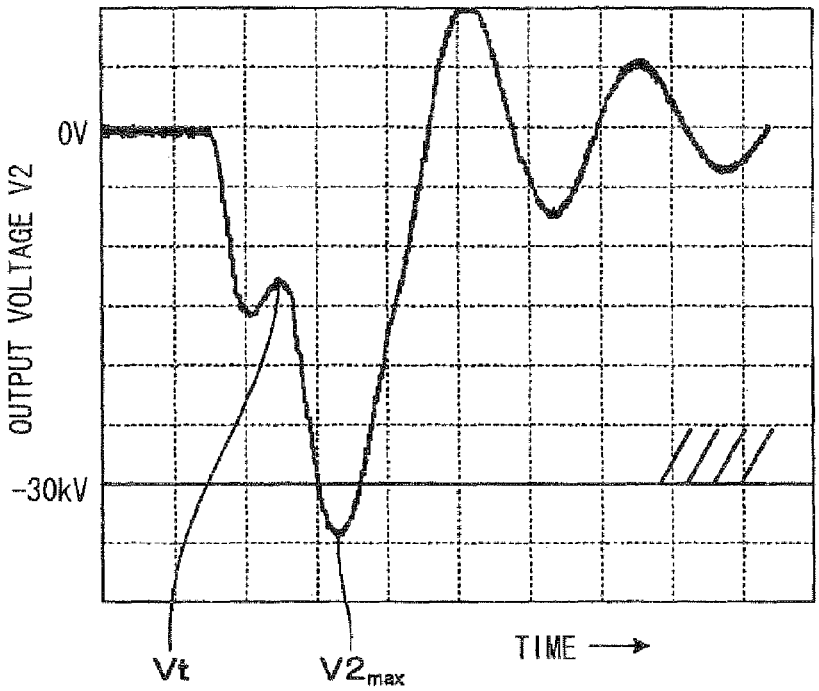
FIG. 5 is a graph illustrating an output voltage waveform with time on its horizontal axis and the output voltage on its vertical axis, when the peak Vt of the high-frequency voltage component is generated before generation of the peak $V2_{max}$ of the output voltage according to the embodiment.
Figure 7:
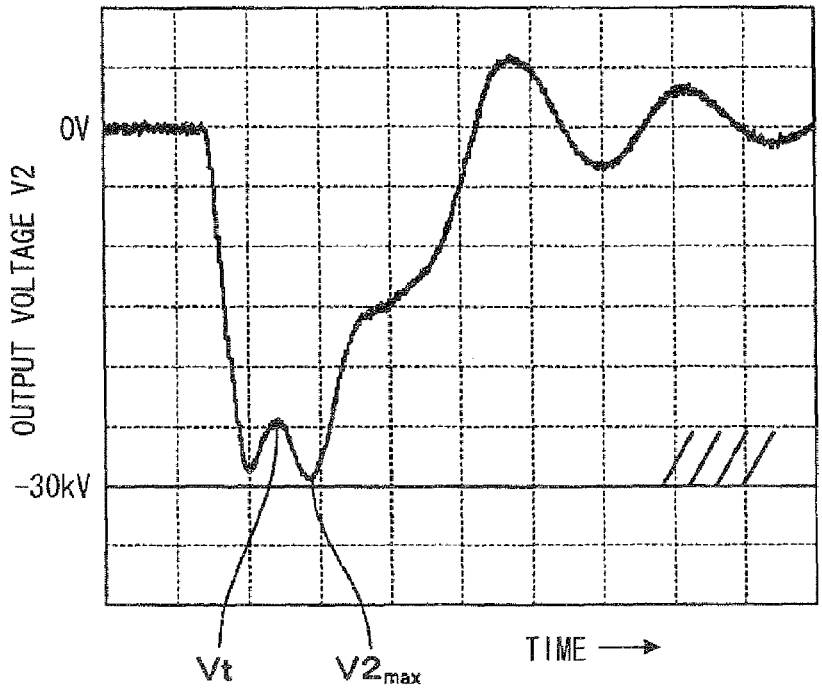
FIG. 7 PRIOR ART
FIG. 7 is a graph illustrating an output voltage waveform with time on its horizontal axis and the output voltage on its vertical axis, when the peak Vt of the high-frequency voltage component overlaps with the peak $V2_{max}$ of the output voltage according to a previously proposed ignition system.

FIGS. 4, 5, 7 are graphs showing output voltage waveforms when a spark is generated, with time on their horizontal axes and the output voltage V2 on their vertical axes. When the coupling coefficient k is in the range of 0.9 to 0.97, as shown in FIG. 4, the generation timing of the peak $V2_{max}$ of the output voltage V2 does not overlap with generation timing of the peak Vt of the high-frequency voltage component attributed to the capacitor 31. In addition, the coupling coefficient k may be set such that nearly the whole high-frequency voltage component attributed to the capacitor 31 does not overlap with the generation timing of the peak $V2_{max}$.

When the coupling coefficient k is larger than 0.97, as shown in FIG. 7, the generation timing of the peak $V2_{max}$ of the output voltage V2 overlaps with the generation timing of the peak Vt of the high-frequency voltage component, and thereby the peak $V2_{max}$ is made low. When the coupling coefficient k is smaller than 0.9, the peak $V2_{max}$ is made significantly low, so that necessary performance of the ignition coil 2 may not be obtained.

In FIGS. 4, 5, 7, the output voltage V2 (target value of the output voltage V2) necessary for the ignition coil 2 is set at −30 kV.

In the embodiment, in the output voltage waveform of the secondary coil 22 in FIG. 4, the peak Vt of the high-frequency voltage component is generated after the peak $V2_{max}$ of the spark voltage V2 is generated. Alternatively, as shown in FIG. 5, the peak Vt may be generated before the peak $V2_{max}$ is generated by appropriately modifying the ignition control circuit 3, the primary coil 21, the secondary coil 22, the center core 23, the outer circumference core 24, and the like.

In the ignition system 1 of the embodiment, the coupling coefficient k is appropriately set by modifying the ignition control circuit 3, the primary coil 21, the secondary coil 22, and the like. Accordingly, in the output voltage waveform of the secondary coil 22 in FIG. 4, the generation timing of the peak Vt of the high-frequency voltage component, which is attributed to the capacitor 31 of the ignition control circuit 3 and appears in the output voltage waveform, does not overlap with the generation timing of the peak $V2_{max}$ of the spark voltage V2 in the secondary coil 22.

By preventing the peak Vt from overlapping with the peak $V2_{max}$, the decrease in the peak $V2_{max}$ is restricted.

Consequently, according to the ignition system 1 of the embodiment, the spark voltage V2 necessary to designing is ensured in the secondary coil 22.

Additional advantages and modifications will readily occur to those skilled in the art. The invention in its broader terms is therefore not limited to the specific details, representative apparatus, and illustrative examples shown and described.

What is claimed is:

1. An ignition system for an internal-combustion engine, said ignition system comprising:

an ignition coil including a primary coil and a secondary coil; and an ignition control circuit that includes a capacitor, wherein:

the ignition control circuit employs a capacitor discharged ignition (CDI) circuit which causes electrical charge, with which the capacitor is charged, to be discharged into the primary coil to drive the ignition coil; and said primary coil being coupled to said secondary coil by a coupling coefficient is set in a range of 0.9 to 0.97, so that timing of generation of a peak spark voltage in the secondary coil is shifted from the timing of generation of a peak of a high-frequency voltage component attributed to the capacitor in a voltage waveform outputted from the secondary coil.

2. The ignition system according to claim 1, wherein the peak of the high-frequency voltage component is generated after generation of the peak of the spark voltage.

3. The ignition system according to claim 1, wherein the length of the secondary coil in an axial direction of the secondary coil is shorter than length of the primary coil in an axial direction of the primary coil sufficient to establish a coupling coefficient in the range of 0.9 to 0.97.

4. The ignition system according to claim 3, wherein an end portion of the primary coil projects further on a high-voltage side of the ignition coil than a high-voltage side end portion of the secondary coil in the axial direction of the primary coil and the secondary coil.

5. The ignition system according to claim 1, wherein the length of the primary coil in an axial direction is shorter than length of the secondary coil in an axial direction sufficient to establish a coupling coefficient in the range of 0.9 to 0.97.

6. The ignition system according to claim 5, wherein a high-voltage side end portion of the secondary coil projects further on a high-voltage side of the ignition coil than an end portion of the primary coil in the axial direction of the primary coil and the secondary coil.

7. The ignition system according to claim 1, wherein the ignition control circuit includes a multiple ignition circuitry and further includes:

an energy accumulation coil for storing electrical energy;

a charge switching element for charging the capacitor with the electrical energy stored in the energy accumulation coil by switching on and off energization of the energy accumulation coil; and a discharge switching element for discharging the electrical charge, with which the capacitor is charged, into the primary coil.

* * * * *